US012449127B2

(12) United States Patent
Kemp et al.

(10) Patent No.: US 12,449,127 B2
(45) Date of Patent: Oct. 21, 2025

(54) BURNER CONTROL SYSTEM

(71) Applicant: Autoflame Engineering Limited, Biggin Hill (GB)

(72) Inventors: Brendan Kemp, Biggin Hill (GB); Duncan Ward, Biggin Hill (GB); Stuart Williams, Biggin Hill (GB)

(73) Assignee: Autoflame Engineering Limited, Biggin Hill (GB)

( * ) Notice: Subject to any disclaimer, the term of this patent is extended or adjusted under 35 U.S.C. 154(b) by 422 days.

(21) Appl. No.: 17/992,086

(22) Filed: Nov. 22, 2022

(65) Prior Publication Data

US 2023/0160572 A1 May 25, 2023

(30) Foreign Application Priority Data

Nov. 24, 2021 (GB) ..... 2116952

(51) Int. Cl.
*F23N 5/00* (2006.01)

(52) U.S. Cl.
CPC ..... *F23N 5/006* (2013.01); *F23N 2229/04* (2020.01); *F23N 2900/05001* (2013.01)

(58) Field of Classification Search
CPC ..... F23N 5/006; F23N 2229/04; F23N 2900/05001
USPC ..... 431/14, 79, 76, 12; 260/554
See application file for complete search history.

(56) References Cited

U.S. PATENT DOCUMENTS

| | | | | |
|---|---|---|---|---|
| 4,653,998 | A * | 3/1987 | Sohma | F23N 5/082 431/12 |
| 4,927,351 | A * | 5/1990 | Hagar | F23N 5/003 431/174 |
| 5,112,217 | A | 5/1992 | Ripka et al. | |
| 5,993,194 | A * | 11/1999 | Lemelson | F23N 5/082 700/47 |
| 2009/0017406 | A1 | 1/2009 | Fuentes et al. | |
| 2020/0408404 | A1 | 12/2020 | Wiesenberg et al. | |

FOREIGN PATENT DOCUMENTS

| | | | |
|---|---|---|---|
| DE | 102019101329 | A1 | 7/2020 |
| EP | 1207345 | A2 | 5/2002 |
| EP | 3663648 | A1 | 6/2020 |
| GB | 1080069 | | 8/1967 |

(Continued)

OTHER PUBLICATIONS

European Search Report and Opinion for EP Application No. 22208861.9, dated May 2, 2023, 6 pages.

*Primary Examiner* — Vivek K Shirsat
(74) *Attorney, Agent, or Firm* — Sterne, Kessler, Goldstein &Fox P.L.L.C.

(57) ABSTRACT

A burner control system for controlling the operation of a fuel burner arranged to burn a combination of a supply of fuel and a supply of air is provided. The burner control system is arranged to receive from an exhaust gas analyzer one or more signals, each signal being indicative of the level of an exhaust gas emitted by the fuel burner; receive from a photodetector a signal indicative of a level of electromagnetic radiation output by the flame of the fuel burner; and control at least one of the supply of fuel and the supply of air to the burner based on the one or more signals received from the exhaust gas analyzer and the signal received from the photodetector.

18 Claims, 5 Drawing Sheets

(56) References Cited

FOREIGN PATENT DOCUMENTS

| | | | |
|---|---|---|---|
| KR | 20010005066 | A | 1/2001 |
| KR | 20060124116 | A | 12/2006 |
| KR | 20130072405 | A | 7/2013 |
| KR | 20150049269 | A | 5/2015 |
| WO | 2016068638 | A1 | 5/2016 |
| WO | 2020255090 | A1 | 12/2020 |

* cited by examiner

BURNER CONTROL SYSTEM

CROSS-REFERENCE TO RELATED APPLICATION

The present application claims priority to GB Application No. 2116952.9, filed on Nov. 24, 2021, which is incorporated herein by reference in its entirety.

FIELD OF THE INVENTION

The present invention concerns a burner control system, a fuel burner, a method of commissioning a fuel burner and a method of operating a fuel burner. More particularly, but not exclusively, the invention concerns a burner control system for use with an industrial fuel burner, that uses a signal from a photodetector that is indicative of a level of electromagnetic radiation output by the flame of the fuel burner.

BACKGROUND

Industrial fuel burners, as used for example for industrial boilers, are commonly commissioned (i.e. configured before first use) to give not only a stable flame, but also to provide efficient combustion. This efficiency is typically achieved by setting the fuel to air ratio to provide an oxygen ($O_2$) level of around 2.5% to 3% in the exhaust gases emitted by the fuel burner, although different levels may be used depending on the capabilities of the burner and the fuel being burnt. This fuel may be gaseous, such as natural gas or hydrogen, liquid such as fuel oil, or solid such as biomass with ideal excess $O_2$ levels varying between the different fuels. Such an $O_2$ level is desirable throughout the firing range of the fuel burner, in other words for all possible levels of fuel that may be supplied to the fuel burner. The $O_2$ level is chosen as it provides a good balance between having excess air to ensure safe combustion, while being as close to the ideal stoichiometric combustion point as possible.

Enabling the desired $O_2$ to be attained is achieved by, during commissioning, carefully setting the angles of the fuel and air dampers for a set of points within the firing range, measuring the exhaust gases, and making fine adjustments to get the desirable emissions. Following commissioning, the fuel burner operates using the determined fuel and air damper angles, using linear interpolation to determine the required angles for firing rates between the set points used during commissioning.

However, a problem with this method of control is that while the volumes of fuel and air can be adjusted very precisely by changing the angles of the dampers, the actual amount of either for a particular damper angle can vary considerably depending on current conditions. For example, the fuel pressure may vary, and the ambient pressure, ambient temperature, and stack pressure will all affect the amount of $O_2$ present in a given volume of air. Such variations will inevitably affect the combustion of the fuel, and can move it away from the ideal performance set during commission.

A known technique for correcting this is to use trimming, whereby the exhaust emitted by the fuel burner are analyzed to determine the levels of different exhaust gases it contains. If the exhaust gases are found to deviate from the ideal combustion set at commission, the air damper angle may be altered slightly to correct for the change in conditions, thus maintaining optimum combustion. A known burner control system that uses exhaust gas analysis to control a fuel burner is described in GB 2169726 A (Autoflame Engineering Limited) published 16 Jul. 1986.

A problem with using the measurement of the exhaust gases to control the operation of a fuel burner is that there is an unavoidable delay between changes being made to the operation of the system, and the effect of these being measurable from the exhaust gases. The total delay is made up of three components:

- The Residence Time of the Boiler: the time taken for the exhaust gases to reach the point in the fuel burner where they are sampled by the exhaust gas analyzer.
- The Measurement Delay: the time for the exhaust gases to be processed by the exhaust gas analyzer and to reach the measurement cells where the gas level readings are obtained.
- The Cell Response Time: the time for the measurement cells to stabilize when the exhaust gases are at new level.

For a multi-pass boiler, for example, the total delay may be of the order of 120 seconds or more. This is exacerbated if the firing rate of the burner is reduced causing air flow through the boiler to slow, and this can result in the total delay increasing up to 6-fold.

It is therefore possible for several minutes to elapse before a change in combustion is corrected and the system stabilizes at the most efficient combustion level. During this time, the combustion of the fuel burner is not at its peak efficiency, resulting in increased fuel costs and increased emissions.

The present invention seeks to solve or mitigate some or all of the above-mentioned problems. Alternatively and/or additionally, the present invention seeks to provide an improved burner control system, an improved fuel burner, an improved method of commissioning a fuel burner and an improved method of operating a fuel burner.

BRIEF SUMMARY

In accordance with a first aspect of the invention there is provided a burner control system for controlling the operation of a fuel burner arranged to burn a combination of a supply of fuel and a supply of air, wherein the burner control system is arranged to:

- receive from an exhaust gas analyzer one or more signals, each signal being indicative of the level of an exhaust gas emitted by the fuel burner;
- receive from a photodetector a signal indicative of a level of electromagnetic radiation output by the flame of the fuel burner; and
- control at least one of the supply of fuel and the supply of air to the burner based on the one or more signals received from the exhaust gas analyzer and the signal received from the photodetector.

It has been found that the level of electromagnetic radiation output by the flame of the fuel burner can be used to determine information about the condition of the combustion of the fuel burner, in particular levels of exhaust gases. Unlike the exhaust gas analyzer there is very little delay in this information becoming available, as the signal from the photodetector changes almost instantaneously when the level of electromagnetic radiation output by the flame of the fuel burner changes. Thus, the fuel burner controller can respond to changes in combustion much more quickly than when the only an exhaust gas analyzer is used, minimizing the time during which the combustion of the fuel burner is not at its peak efficiency.

However, the signal from the photodetector is more susceptible to fluctuations than the exhaust gas analyzer, for example due to flickering of the flame. In addition, control systems that use exhaust gas analysis are much more well-established. By combining the use of both types of measurement, the photodetector can advantageously be used to provide quick adjustment when required, with the more robust and trusted exhaust gas analysis still being available. In addition, the use of exhaust gas analysis allows multiple different exhaust gases to be measured. It is a known problem with burner control systems that measure only $O_2$ that under certain conditions, fuel burners can emit carbon monoxide (CO) despite the $O_2$ level being as desired. The use of an exhaust gas analyzer that measures CO levels in addition to the $O_2$ being measured can mitigate this problem.

The one or more signals received from the exhaust gas analyzer may include signals indicative of levels of one or more of oxygen ($O_2$), carbon dioxide ($CO_2$) and carbon monoxide (CO). Alternatively and/or additionally, signals indicative of levels of other gases may be included. Two or more signals may be received from the exhaust gas analyzer.

The burner control system may be arranged to determine a level of oxygen emitted by the fuel burner from the signal received from the photodetector. It has been found that the level of electromagnetic radiation output by the flame of the fuel burner can provide a particularly reliable indication of the level of $O_2$ emitted by the fuel burner.

A signal of the one or more signals received from the exhaust gas analyzer may be indicative of the level of oxygen emitted by the fuel burner. In this case, the burner control system may be arranged to determine a level of oxygen emitted by the fuel burner from a combination of the signal received from the photodetector and the signal indicative of the level of oxygen received from the exhaust gas analyzer. This allows the quick response of the photodetector to changes in $O_2$ level to be used, but with the use of the level from the exhaust gas analyzer ensuring that the burner control system does not react too quickly to temporary variations in the signal received from the photodetector, which are more subject to fluctuations. The level of oxygen may be determined by averaging the outputs of the photodetector and the exhaust gas analyzer, for example, or by any other suitable method.

The burner control system may be arranged to compare: the level of oxygen determined from the signal received from the photodetector; and the level of oxygen indicated by the signal indicative of the level of oxygen received from the exhaust gas analyzer; and to adjust the level of oxygen determined from the signal received from the photodetector where the levels differ by more than a predetermined threshold. In this way, the level determined by the photodetector can be corrected if required, for example due to the behavior of the photodetector changing at higher temperatures.

The signal received from the photodetector may be indicative of a level of ultraviolet radiation output by the flame. It has been found that the level of ultraviolet radiation output by the flame of the fuel burner provides a particularly reliable indication of the level of $O_2$ emitted by the fuel burner. Alternatively and/or additionally, the signal received from the photodetector may be indicative of a level of visible light, infrared or any combination thereof output by the flame.

The signal received from the photodetector may be a single value indicative of a total level of electromagnetic radiation output by the flame. This provides a simple but nevertheless effective value to use. It will be understood that by total level is meant the total level of electromagnetic radiation in the range in which the photodetector operates.

The signal received from the photodetector may be determined from an average of the output of the photodetector over a predetermined period of time. This mitigates issues arising from the fluctuation of the signal received from the photodetector, for example due to flickering of the flame. The output of the photodetector may be averaged over 1 second, 10 seconds, or 20 seconds, for example. The period over which the output of the photodetector is averaged may be based upon the type of fuel and/or the properties of the fuel burner in which the burner control system is used, for example.

The burner control system may be arranged to: determine a desired proportion of fuel to air for the burner from a combination of the one or more signals received from the exhaust gas analyzer, and the signal received from the photodetector; and control at least one of the supply of fuel and the supply of air to the burner to be in accordance with the determined desired proportion of fuel to air. This provides a simple method for controlling the fuel burner using the various received signals. In this case, the determined desired proportion of fuel to air may be dependent upon the level of supply of fuel to the fuel burner. The level of supply of fuel to the fuel burner is often referred to as the "firing rate" of the fuel burner.

Alternatively, the burner control system may be arranged: when in a first operative state, to control at least one of the supply of fuel and the supply of air to the burner based on the signal received from the photodetector; and when in a second operative state, to control at least one of the supply of fuel and the supply of air to the burner based on the one or more signals received from the exhaust gas analyzer. In this way, the burner control system is able to alternate between using the photodetector or exhaust gas analyzer as appropriate.

The burner control system may be arranged to move from the first operative state to the second operative state when the signal received from the photodetector is within a predetermined threshold for a predetermined period of time. In other words, the system can use the photodetector, which has a quick response time, until the behavior of the fuel burner stabilizes, at which point it can switch to using the slower-responding exhaust gas analyzer. In this case, the burner control system may be arranged to move from the second operative state to the first operative state when the signal received from the photodetector moves outside of the predetermined threshold. Different thresholds may be used for different operating conditions, for example different firing rates. The burner control system may be arranged to move from the second operative state to the first operative state in response to a change in the level of supply of fuel to the fuel burner. Such a change will likely result in a significant change in the operation of the fuel burner, for which the quick response of the photodetector is advantageous. Alternatively and/or additionally the burner control system may be arranged to move from the second operative state to the first operative state when a signal of the one or more signals received from the exhaust gas analyzer indicates that the level of a first exhaust gas being above a predetermined threshold. In this case, the first exhaust gas may be oxygen. This allows a significant change in the $O_2$ level identified by the exhaust gas analyzer, but for which the exhaust gas analyzer would not be able to respond to quickly, to be instead responded to using the photodetector.

Alternatively, the burner control system may be arranged to move from the first operative state to the second operative state when a signal of the one or more signals received from the exhaust gas analyzer indicates that the level of a second exhaust gas has risen above a predetermined level. In this case, the second exhaust gas may be carbon monoxide. This can provide a fail-safe when the fuel burner is not operating as required based on the signal received from the photodetector.

It will be appreciated that the burner control system may be arranged to move between the first operative state and the second operative state according to other methods, for example alternating between them for different periods of time.

The burner control system may be arranged to determine, from the signal received from the photodetector, the presence or absence of a flame in the fuel burner. This can provide a convenient safety feature, in addition to controlling the operation of the fuel burner.

The supply of fuel to the fuel burner may be a supply of one or more of natural gas, hydrogen, fuel oil or biomass.

In accordance with a second aspect of the invention there is provided a fuel burner arranged to burn a combination of a supply of fuel and a supply of air, comprising:

- an exhaust gas analyzer arranged to generate a one or more signals, each signal being indicative of the level of an exhaust gas emitted by the fuel burner;
- a photodetector arranged to generate a signal indicative of a level of electromagnetic radiation output by the flame of the fuel burner; and
- a burner control system as described above.

The photodetector may be located in the combustion chamber of the fuel burner. The photodetector may be an ultraviolet photodetector. Alternatively and/or additionally, the photodetector may a visible light photodetector, infrared photodetector or a photodetector for any combination thereof. The photodetector may be a photodiode. The photodetector may detect electromagnetic radiation in the range of 100 nm to 400 nm, 400 nm to 700 nm, or 2.5 μm to 5 μm for example.

The supply of fuel may be a supply of one or more of natural gas, hydrogen, fuel oil or biomass.

In accordance with a third aspect of the invention there is provided a method of commissioning a fuel burner as described above, comprising the steps of:

- operating the fuel burner at a plurality of combinations of operational parameters, the operational parameters including at least the level of supply of fuel and level supply of air to the fuel burner;
- determining for each combination of operational parameters a level of oxygen emitted by the fuel burner;
- recording for each combination of operational parameters the one or more signals generated by the exhaust gas analyzer and the signal output by the photodetector; and
- determining a mapping from the operational parameters, one or more signals generated by the exhaust gas analyzer and signal output by the photodetector to the level of oxygen emitted by the fuel burner.

The method may further comprise the steps of: for each combination of operational parameters, determining air rich and air lean combinations of operational parameters on either side of the combination of operational parameters; and recording for the air rich and air lean combination of operational parameters the one or more signals generated by the exhaust gas analyzer and the signal output by the photodetector. By measuring the air rich and air lean combinations during the commission process, a commission map can be formed which allows the required adjustment of the air damper to be determined in order to correct an offset in the $O_2$ level.

The level of oxygen emitted by the fuel burner may be determined for each combination of operational parameters by using an external calibrated oxygen detector, which is used only during commissioning.

In accordance with a fourth aspect of the invention there is provided a method of operating a fuel burner commissioned using the method described above, the method comprising controlling the fuel burner using the determined mapping.

In this way, the determined mapping can be used to enable the level of $O_2$ emitted by the fuel burner to be identified, and a desired level of $O_2$ to be achieved, using the combination of the signals generated by the exhaust gas analyzer and photodetector.

It will of course be appreciated that features described in relation to one aspect of the present invention may be incorporated into other aspects of the present invention. For example, the method of the invention may incorporate any of the features described with reference to the apparatus of the invention and vice versa.

BRIEF DESCRIPTION OF THE DRAWINGS/FIGURES

Embodiments of the present invention will now be described by way of example only with reference to the accompanying schematic drawings of which:

DETAILED DESCRIPTION

Figure 1:
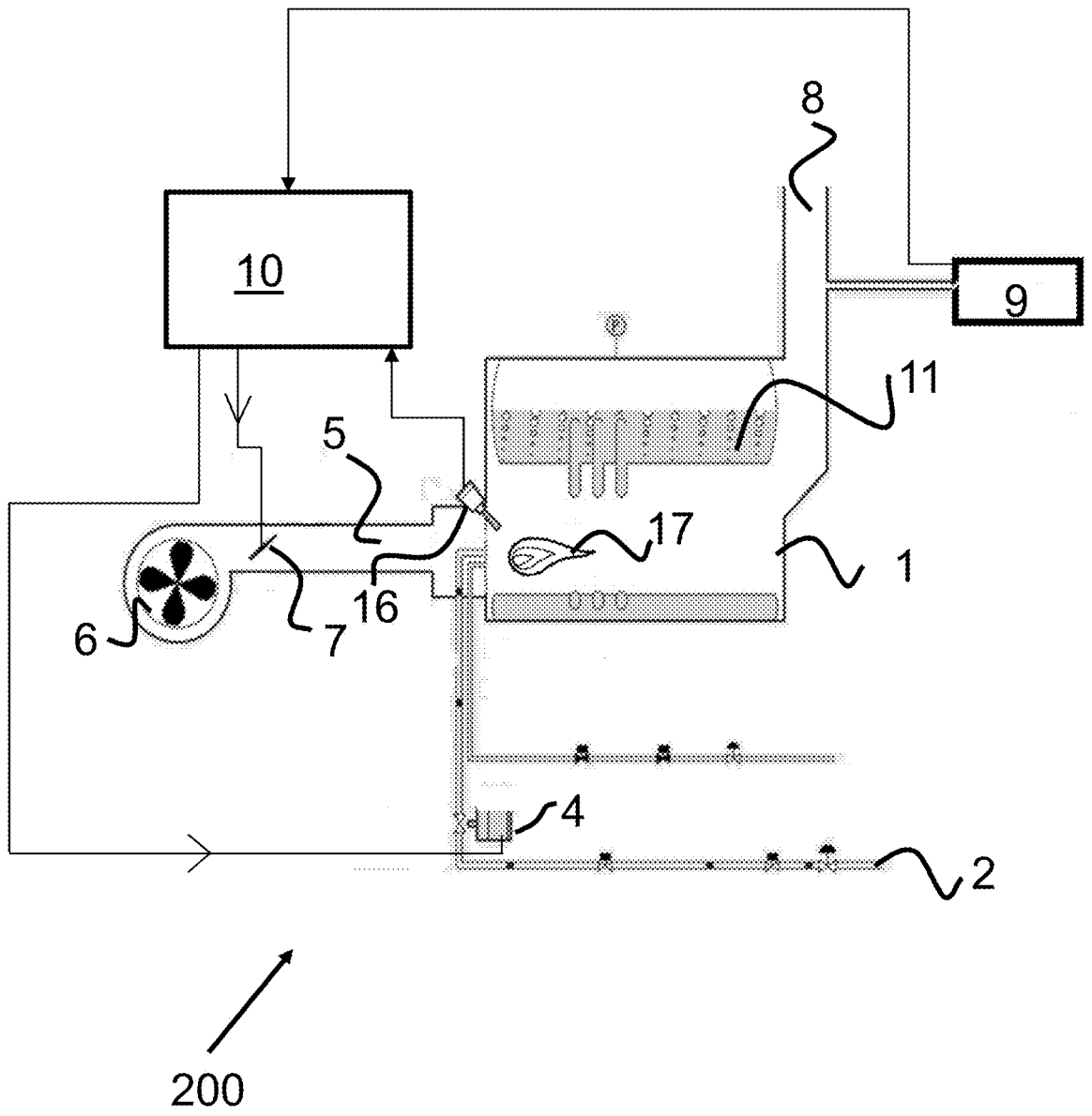
FIG. 1 shows a schematic view of a fuel burner system according to a first embodiment of the invention.

FIG. 1 shows a schematic view of a fuel burner system according to a first embodiment of the invention. The fuel burner system 200 is of a type suitable for use as part of a commercial boiler installation which may for example be employed in the process or heating system of large premises, for example a factory, offices, a hotel or hospital. However, it will be appreciated that in other embodiments other types of fuel burner systems could be used.

The fuel burner system 200 comprises a fuel burner 1 to which fuel is fed via a duct 2, in which is located a fuel damper 4 to control the supply of fuel to the fuel burner 1. In addition, air is drawn from outside the fuel burner system 200 by a fan 6, and fed to the fuel burner 1 by a duct 5, in which is located an air damper 7 to control the supply of air to the fuel burner 1. In the present embodiment the fuel burner 1 is a gas burner supplied with natural gas, hydrogen gas or the like, but in other embodiments other types of fuel may be used, for example oil fuel or biomass.

In the fuel burner 1, the gas and air are mixed and combustion takes place, creating a flame 17. The heat generated by the combustion heats a supply of water 11. The exhaust gases and other combustion products that follow combustion by the fuel burner 1 are emitted via an exhaust 8.

An exhaust gas analyzer 9 is positioned in the exhaust 8. The exhaust gas analyzer 9 extracts and analyses the levels of exhaust gases exiting through the exhaust 8. In the present embodiment, the levels of $O_2$, CO and $CO_2$ are measured, though in other embodiments levels of further and/or other exhaust gases may be measured.

In addition, an ultraviolet photodiode 16 (i.e. a photodiode that converts ultraviolet radiation to an electrical current) is located in the combustion chamber of the fuel burner 1, where it receives electromagnetic radiation (e.g. visible light, ultraviolet and infrared), and particularly ultraviolet radiation, generated by the flame 17.

The ultraviolet photodiode 16 is a simple photodiode, without any filtering or electronic processing to select wavelengths or the like (though as discussed below it comprises a variable gain circuit, but only to amplify the signal it generates). In other embodiments, other photodiodes may be used, for example photodiodes that convert visible light, infrared, or any combination thereof (including in combination with ultraviolet) to an electrical current. The photodiode may also be located other than in the combustion chamber, as long as it is still able to receive electromagnetic radiation generated by the flame. In particular, the photodiode should be positioned so that it has a good view of the heart of the flame, as this maximizes the size of the ultraviolet response, and ensures that any changes in the ultraviolet level are directly proportional to the amount of ultraviolet radiation emitted by the flame. Having an obscured view of the flame, or pointing the photodiode towards the edge of the flame, may result in an erroneous assessment of the actual total ultraviolet being emitted by the flame. A control unit 10 controls the operation of the fuel burner 1, by controlling the fuel damper 4 and air damper 7 to adjust the gas and air flow rates to the fuel burner 1. The operation of the fan 6 is also controlled by the control unit 10. In this way, the control unit 10 controls the amounts of gas and air burnt by the gas burner, so controlling the operation of the gas burner.

Further, the control unit 10 receives signals from the exhaust gas analyzer 9 indicating the levels of $O_2$, CO and $CO_2$ emitted through the exhaust 8. As in known systems, the control unit 10 is able to use these levels to optimize the operation of the fuel burner 1, in particular the level of $O_2$ emitted as an exhaust gas, by adjusting the fuel damper 4, air damper 7 and fan 6 as to give the fuel to air ratio required to give the desired level of $O_2$.

Figure 2:
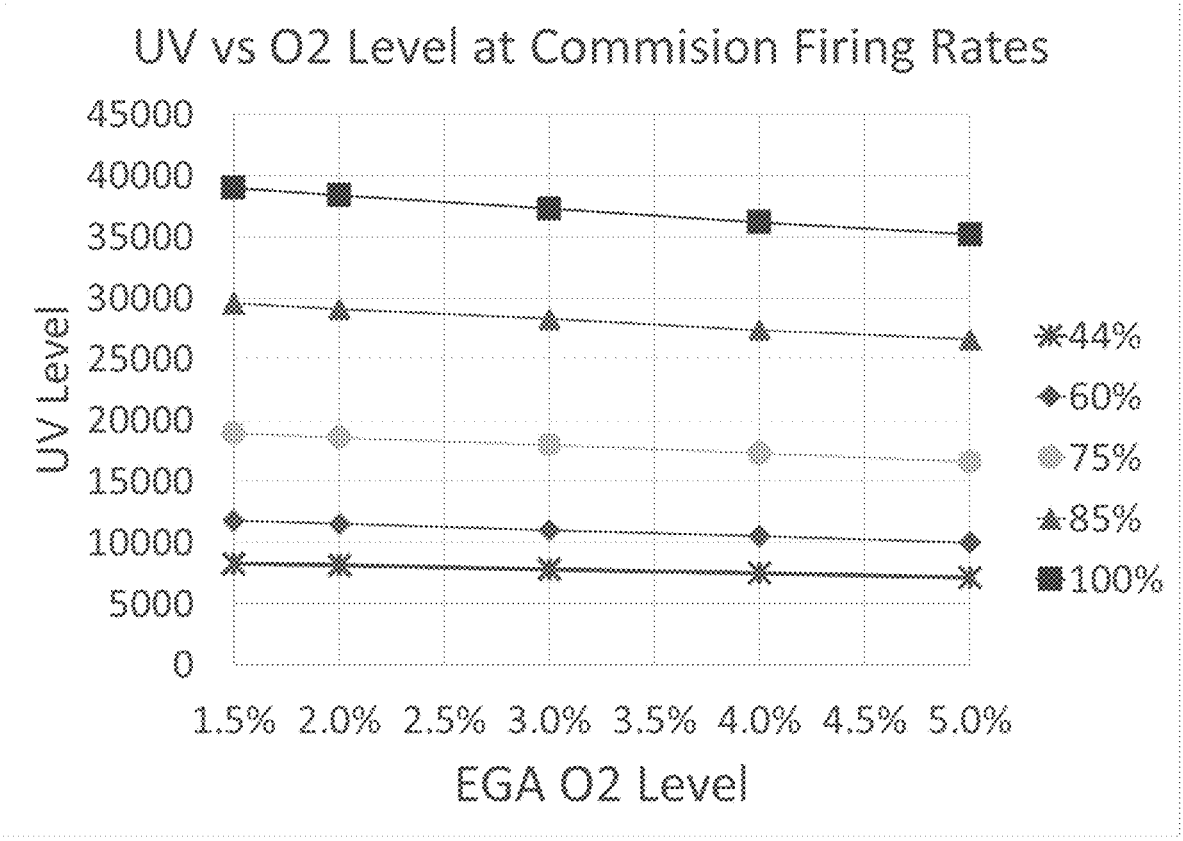
FIG. 2 is a graph showing ultraviolet level against $O_2$ level for different firing rates of a fuel burner.

However, the control unit 10 also receives a signal from the ultraviolet photodiode 16. This gives a single level indicative of the ultraviolet radiation the ultraviolet photodiode 16 has received from the flame 17. As mentioned above, no filtering or processing of the ultraviolet photodiode 16 or its signal is performed, the signal it outputs is purely an electrical current generated in response to the ultraviolet radiation it receives. It has been found that the amount of ultraviolet radiation emitted by a flame varies linearly with that of the percentage of $O_2$ present in the exhaust gases of the boiler, for a given firing rate. The measured UV level of the flame is observed to decrease linearly as the excess oxygen level increases, for a given firing rate. This can be seen in FIG. 2, which shows the ultraviolet level against $O_2$ level for different firing rates of a fuel burner.

Figure 3:
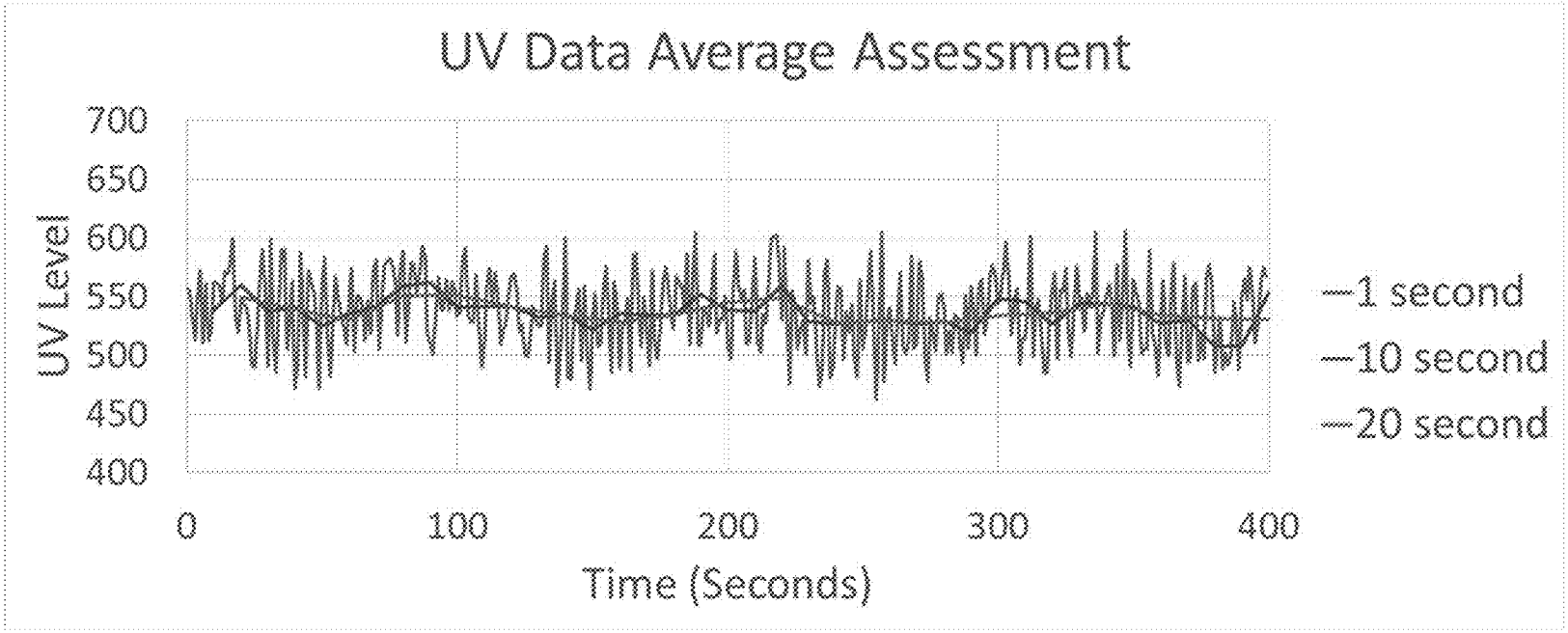
FIG. 3 is a graph showing the signal from an ultraviolet photodiode of the fuel burner system of the first embodiment averaged over different time periods.

In contrast to the signals from the exhaust gas analyzer 9, it has been found that the signal from the ultraviolet photodiode 16 is subject to considerable fluctuation, due to flickering of the flame 17. To mitigate this, the signal from the ultraviolet photodiode 16 is averaged over a time period prior to being used to determine the $O_2$ level, for example for 10 seconds or 20 seconds. FIG. 3 shows an example of the signal ultraviolet photodiode 16 over a time period, averaged over one second (which it can be seen still gives considerable fluctuation), 10 seconds, and 20 seconds. The averaging is done by the control unit 10, but in other embodiments may be done at the ultraviolet photodiode 16 prior to transmitting to the control unit 10.

As mentioned above, the ultraviolet photodiode 16 comprises a variable gain circuit to amplify the signal it generates. This allows an optimum gain to be set during commissioning of the fuel burner system 200, so that the signal is as large as possible without going into saturation at the peak firing rate, so provides good signal strength throughout the firing range.

As well as being used to determine the level of $O_2$, the ultraviolet photodiode 16 may be used to as a safety feature to determine the presence or absence of a flame, similarly to a standard flame scanner. The control unit 10 can then use this to ensure safe combustion.

Figure 4:
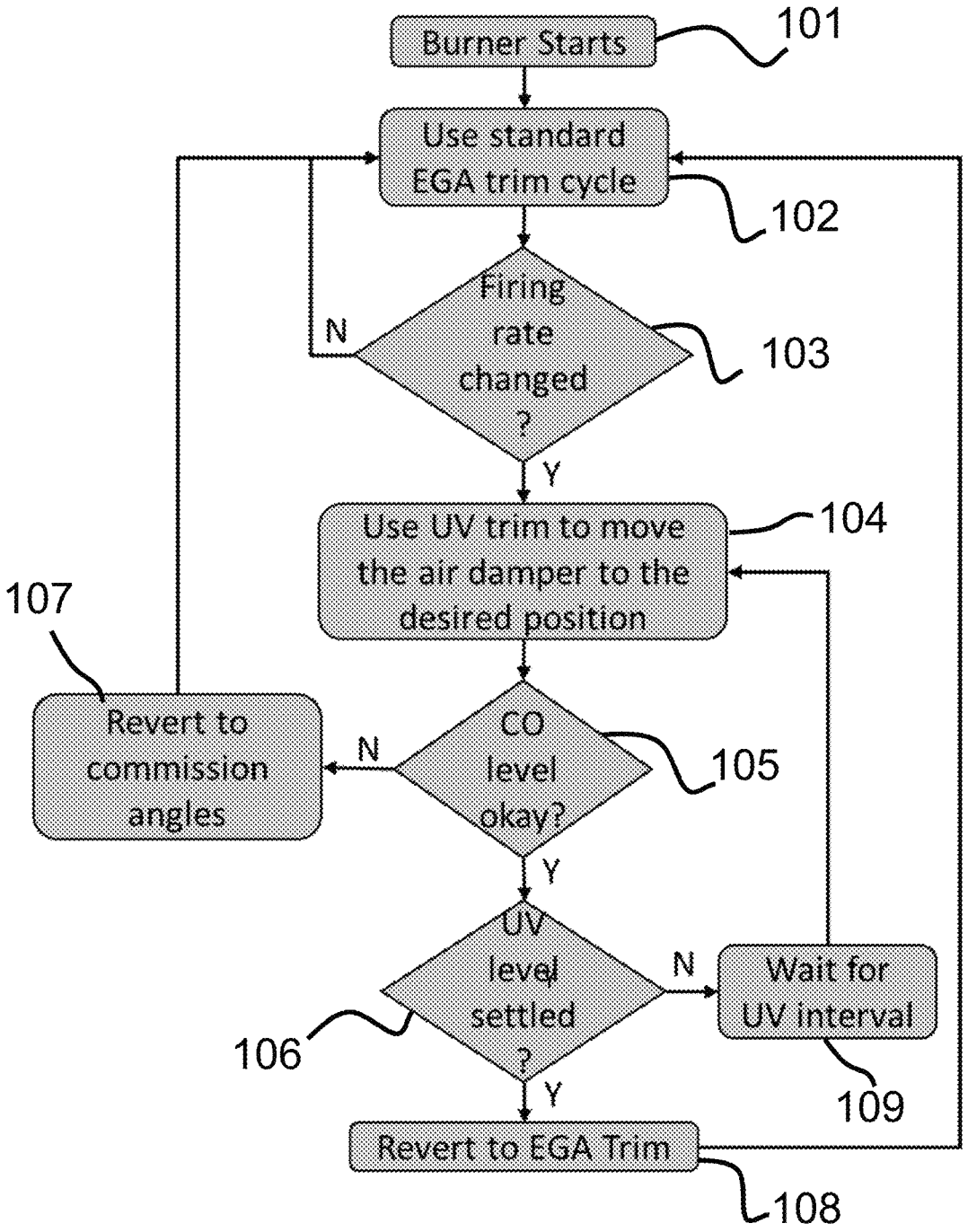
FIG. 4 is a flow chart showing the operation of the fuel burner system of the first embodiment.

The control unit 10 can then use the signal from the ultraviolet photodiode 16 as measure of $O_2$ level, in addition to the levels of $O_2$, CO and $CO_2$ from the exhaust gas analyzer 9, to control the fuel burner 1. FIG. 4 is a flowchart showing the operation of the fuel burner system 200.

In a first step, the fuel burner 1 is started (step 101). In standard operation (step 102), the control unit 10 uses the signals received from the exhaust gas analyzer 9 to perform trimming (known as the "EGA trim"), i.e. to adjust the fuel damper 4 and air damper 7 as required to maintain optimum combustion. Any changes in the firing rate are detected (step 103). If no changes are detected, the standard EGA trim cycle is continued.

However, if a change in the firing rate is detected, instead of using EGA trim the control unit 10 uses the signal from the ultraviolet photodiode 16 to determine how to trim the system ("UV trim"), i.e. to move the air damper 7 to the desired position (step 104). The calculation uses the commissioned, air rich and air lean ultraviolet measurements recorded during commissioning of the fuel burner system 200 to calculate the change in ultraviolet that is needed for the desired $O_2$ level to be occurring, and thus the change in the angle of the air damper 7 that is required. Linear interpolation is used to determine the required offset in ultraviolet reading for any firing rate in between the points used during commissioning. The air damper 7 is moved to the new position in small steps to prevent it overshooting the desired angle and causing an oscillating behavior. Alternatively changing the fan 6 speed may be used as an alternative to moving the air damper 7 to control the $O_2$ level.

While UV trim is being used, the exhaust gas analyzer 9 continues to be used to measure the CO level in the exhaust 8 (step 105). If this rises to an undesirable level, the angles of the air damper 7 and fuel damper 4 are moved to those determined during commissioning (step 107), and the control unit 10 returns to using EGA trim again (step 102 again), so that safe operation is resumed, even if it may not immediately be optimal in terms of the $O_2$ level. In fact, the exhaust gas analyzer 9 also continues to be used to measure the other exhaust gases, to identify if safe combustion is not occurring so that steps can be taken if required. In addition, it may be identified that the $O_2$ level indicated by the ultraviolet photodiode 16 is inaccurate, which can occur at high temperatures for example, in which case the $O_2$ level measurements from the exhaust gas analyzer 9 can be used to correct the $O_2$ level determined from the signal from the ultraviolet photodiode 16.

Again while UV trim is being used, the control unit 10 periodically checks if the ultraviolet level as determined by the ultraviolet photodiode 16 has stabilized (step 106). If not, a period of time is waited before checking again (step 109, then returning to step 104). This period of time may be 5 or 10 seconds, for example.

However, if it is found that the ultraviolet level as determined by the ultraviolet photodiode 16 has settled, then the control unit 10 returns to using EGA trim (step 102).

Figure 5:
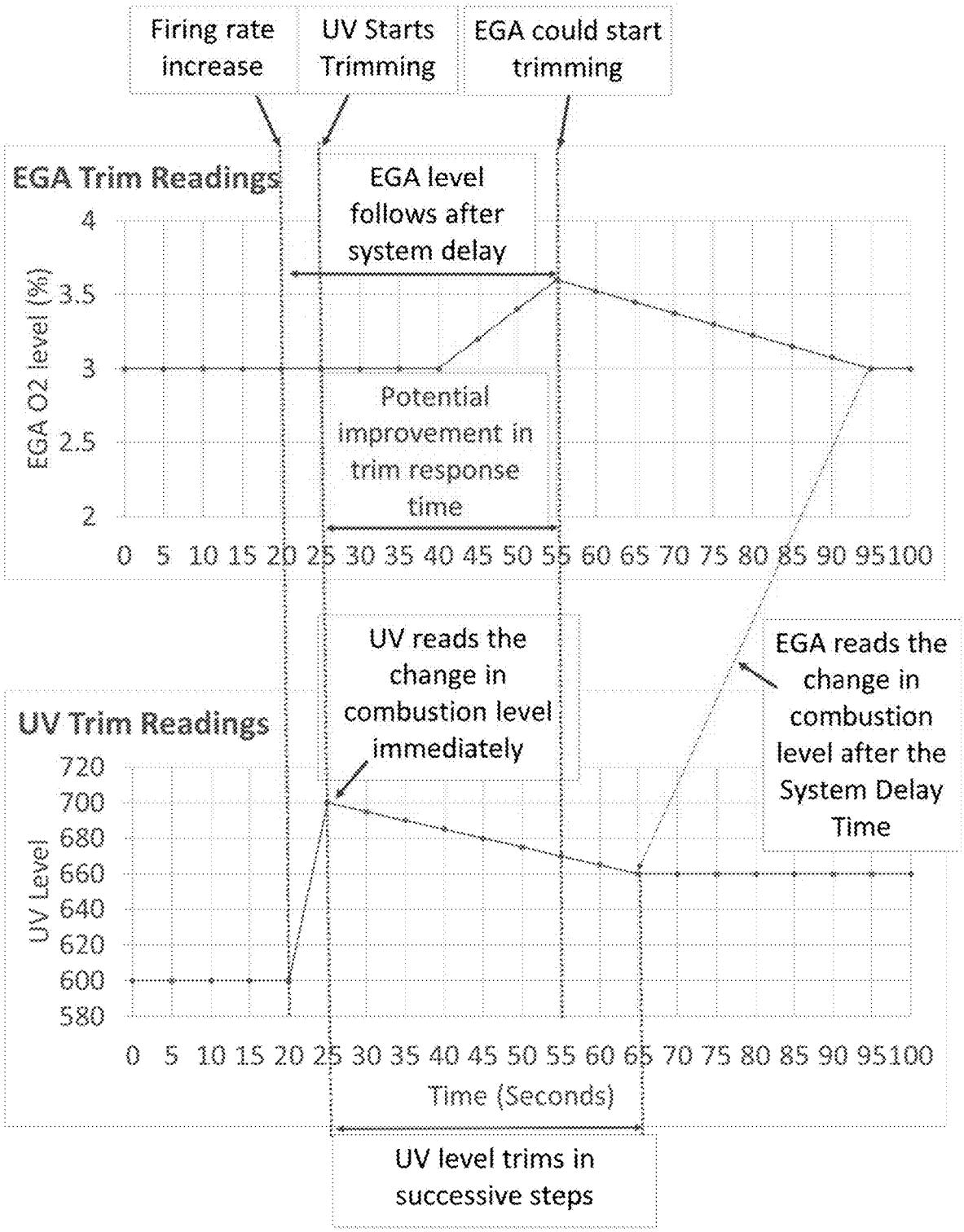
FIG. 5 is a graph showing the response of the ultraviolet photodiode and an exhaust gas analyzer of the fuel burner system of the first embodiment in response to a change in the firing rate of the fuel burner system.

In this way, the well-established EGA trim method of controlling the fuel burner system 200 can be used when the fuel burner system 200 is in the steady state. However, when the firing rate is changed, which creates a significant change in the operating conditions of the fuel burner 1 in a short amount of time, UV trim can be used to make changes to the fuel burner 1, with rapid feedback as to their effects being available due to the quick response of the ultraviolet photodiode 16, to enable optimum conditions to be quickly returned to. FIG. 5 is a graph showing example UV trim reading and EGA trim readings following a change in the firing rate over time. As can be seen, the UV trim is able to react to and adjust to take account of the firing rate change very quickly, compared to the EGA trim, which reacts much more slowly.

In the above embodiment, the signal from the ultraviolet photodiode 16 is used by the control unit 10 to control the operation of the fuel burner 1 when the firing rate is changed, with the signals from the exhaust gas analyzer 9 being used in standard operation. However, in other embodiments the control unit 10 could use the signals in other ways. For example, in an embodiment the ultraviolet photodiode 16 could be used for standard operation of the fuel burner system 200, effectively as a replacement for the exhaust gas analyzer 9, with the exhaust gas analyzer 9 only being used to detect unsafe behavior due to excess CO or the like, or to detect and correct the $O_2$ level indicated by ultraviolet photodiode 16 when it becomes inaccurate, for example. In another embodiment, the signal from the ultraviolet photodiode 16 could be used as simply another parameter taken into account during commissioning, so that rather than the fuel burner 1 being controlled based on a mapping of exhaust gas analyzer 9 measurements and operating parameters (e.g. firing rate, damper angles) determined during commissioning of the fuel burner system 200, the ultraviolet photodiode 16 measurement is also incorporated as a parameter of the mapping. In another embodiment, the $O_2$ level from the ultraviolet photodiode 16 could be used to supplement the $O_2$ level from the exhaust gas analyzer 9, for example by averaging the two levels. It will be appreciated that various other control methods could be used in other embodiments of the invention.

While the present invention has been described and illustrated with reference to particular embodiments, it will be appreciated by those of ordinary skill in the art that the invention lends itself to many different variations not specifically illustrated herein.

Where in the foregoing description, integers, or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

What is claimed is:

1. A burner control system for controlling the operation of a fuel burner arranged to burn a combination of a supply of fuel and a supply of air, wherein the burner control system is arranged to:

receive from an exhaust gas analyzer one or more signals, each of the one or more signals being indicative of a level of an exhaust gas emitted by the fuel burner;

receive from a photodetector a signal indicative of a level of electromagnetic radiation output by a flame of the fuel burner, wherein the signal received from the photodetector is a single value indicative of a total level of electromagnetic radiation output by the flame;

determine a level of oxygen emitted by the fuel burner from the signal received from the photodetector; and control at least one of the supply of fuel and the supply of air to the fuel burner based on the one or more signals received from the exhaust gas analyzer and the signal received from the photodetector.

2. The burner control system as claimed in claim 1, wherein a signal of the one or more signals received from the exhaust gas analyzer is indicative of the level of oxygen emitted by the fuel burner.

3. The burner control system as claimed in claim 2, wherein the burner control system is further arranged to determine the level of oxygen emitted by the fuel burner from a combination of the signal received from the photodetector and the signal indicative of the level of oxygen emitted by the fuel burner received from the exhaust gas analyzer.

4. The burner control system as claimed in claim 1, wherein the signal received from the photodetector is indicative of a level of ultraviolet radiation output by the flame.

5. The burner control system as claimed in of claim 1, wherein the burner control system is further arranged:

when in a first operative state, to control at least one of the supply of fuel and the supply of air to the fuel burner based on the signal received from the photodetector; and when in a second operative state, to control at least one of the supply of fuel and the supply of air to the fuel burner based on the one or more signals received from the exhaust gas analyzer.

6. The burner control system as claimed in claim 5, wherein the burner control system is further arranged to move from the first operative state to the second operative state when the signal received from the photodetector is within a predetermined threshold for a predetermined period of time.

7. The burner control system as claimed in claim 6, wherein the burner control system is further arranged to move from the second operative state to the first operative state when the signal received from the photodetector moves outside of the predetermined threshold.

8. The burner control system as claimed in claim 5, wherein the burner control system is further arranged to move from the second operative state to the first operative state in response to a change in a level of the supply of fuel to the fuel burner.

9. A burner control system as claimed in claim 5, wherein the burner control system is further arranged to move from the second operative state to the first operative state when a signal of the one or more signals received from the exhaust gas analyzer indicates that a level of a first exhaust gas is above a predetermined threshold.

10. The burner control system as claimed in claim 9, wherein the first exhaust gas is oxygen.

11. The burner control system as claimed in claim 5, wherein the burner control system is further arranged to move from the first operative state to the second operative state when a signal of the one or more signals received from the exhaust gas analyzer indicates that a level of a second exhaust gas has risen above a predetermined level.

12. The burner control system as claimed in claim 11, wherein the second exhaust gas is carbon monoxide.

13. A fuel burner arranged to burn a combination of a supply of fuel and a supply of air, comprising:

an exhaust gas analyzer arranged to generate one or more signals, each of the one or more signals being indicative of a level of an exhaust gas emitted by the fuel burner;

a photodetector arranged to generate a signal indicative of a level of electromagnetic radiation output by a flame of the fuel burner; and a burner control system arranged to:

receive from the exhaust gas analyzer the one or more signals;

receive from the photodetector the signal indicative of the level of electromagnetic radiation output by the flame of the fuel burner, wherein the signal received from the photodetector is a single value indicative of a total level of electromagnetic radiation output by the flame;

determine a level of oxygen emitted by the fuel burner from the signal received from the photodetector; and control at least one of the supply of fuel and the supply of air to the fuel burner based on the one or more signals received from the exhaust gas analyzer and the signal received from the photodetector.

14. The fuel burner as claimed in claim 13, wherein the photodetector is located in a combustion chamber of the fuel burner.

15. The fuel burner as claimed in claim 13, wherein the photodetector is an ultraviolet photodetector.

16. The fuel burner as claimed in claim 13, wherein the photodetector is a photodiode.

17. A method of commissioning the fuel burner as claimed in claim 13, comprising:

operating the fuel burner at a plurality of combinations of operational parameters, the operational parameters including at least a level of the supply of fuel and a level of the supply of air to the fuel burner;

determining for each of the plurality of combinations of operational parameters the level of oxygen emitted by the fuel burner;

recording for each of the plurality of combinations of operational parameters the one or more signals generated by the exhaust gas analyzer and the signal generated by the photodetector; and determining a mapping from the operational parameters, the one or more signals generated by the exhaust gas analyzer and the signal generated by the photodetector to the level of oxygen emitted by the fuel burner.

18. The method of commissioning the fuel burner as claimed in claim 17, further comprising:

for each of the plurality of combinations of operational parameters, determining air rich and air lean combinations of operational parameters on either side of the combination of operational parameters; and recording for the air rich and air lean combinations of operational parameters the one or more signals generated by the exhaust gas analyzer and the signal generated by the photodetector.

* * * * *